US005976001A

United States Patent [19]

Powell et al.

[11] Patent Number: 5,976,001

[45] Date of Patent: Nov. 2, 1999

[54] INTERRUPTED CUT ABRASIVE TOOL

[75] Inventors: David G. Powell, Wellesley Hills; Stanley A. Watson, Franklin, both of Mass.

[73] Assignee: Diamond Machining Technology, Inc., Marlborough, Mass.

[21] Appl. No.: 08/840,050

[22] Filed: Apr. 24, 1997

[51] Int. Cl.[6] ..... B23F 21/03; B23F 21/23; B24B 33/00

[52] U.S. Cl. ..... 451/540; 451/556; 451/523; 451/524; 451/557

[58] Field of Search ..... 451/28, 523, 524, 451/525, 526, 544, 553, 556, 557, 540; 407/29.1, 29.14, 29.15; 51/295, 293; 29/76.1; 7/162

[56] References Cited

U.S. PATENT DOCUMENTS

| | | |
|---|---|---|
| 2,360,798 | 10/1944 | Seligman et al. . |
| 3,287,862 | 11/1966 | Abernathy . |
| 3,517,464 | 6/1970 | Mattia et al. . |
| 3,785,938 | 1/1974 | Sam . |
| 3,860,400 | 1/1975 | Prowse et al. . |
| 4,047,902 | 9/1977 | Wiand . |
| 4,078,906 | 3/1978 | Green . |
| 4,079,552 | 3/1978 | Fletcher . |
| 4,155,721 | 5/1979 | Fletcher . |
| 4,256,467 | 3/1981 | Gorsuch . |
| 4,381,227 | 4/1983 | Narcus . |
| 4,460,382 | 7/1984 | Ohno . |
| 4,560,853 | 12/1985 | Ziegel . |
| 4,608,128 | 8/1986 | Farmer et al. . |
| 4,826,508 | 5/1989 | Schwartz et al. . |
| 4,874,478 | 10/1989 | Ishak et al. . |
| 4,945,686 | 8/1990 | Wiand . |
| 5,022,895 | 6/1991 | Wiand . |
| 5,049,165 | 9/1991 | Tselesin . |
| 5,131,924 | 7/1992 | Wiand . |
| 5,133,782 | 7/1992 | Wiand . |
| 5,161,335 | 11/1992 | Tank . |
| 5,203,881 | 4/1993 | Wiand . |
| 5,317,839 | 6/1994 | Anderson . |

FOREIGN PATENT DOCUMENTS

| | | |
|---|---|---|
| 0 238 434 A2 | 9/1987 | European Pat. Off. . |
| 1 229 980 | 4/1971 | United Kingdom . |
| WO 93/04818 | 3/1993 | WIPO . |
| WO 96/14963 | 5/1996 | WIPO . |

OTHER PUBLICATIONS

Miller, Paul C., "Cutting–tool coatings: Many strengths," Tooling & Production, Sep., 1991, pp. 34–37.

Diamond Machining Technology, Inc., Unique Diamond Sharpening Products for Industry (1996).

*Primary Examiner*—Derris Holt Banks
*Attorney, Agent, or Firm*—Fish & Richardson P.C.

[57] ABSTRACT

An abrasive tool includes a base having an upper surface and a perforated sheet having a lower surface and an upper surface. A layer of abrasive grains is bonded to the upper surface of the perforated sheet. The upper surface of the base is bonded to the lower surface of the perforated sheet by a brazing material. A method of assembling an abrasive tool includes bonding the upper surface of the base and the lower surface of the perforated sheet by brazing the surfaces together and bonding a layer of abrasive grains to the upper surface of the perforated sheet.

28 Claims, 3 Drawing Sheets

INTERRUPTED CUT ABRASIVE TOOL

BACKGROUND OF THE INVENTION

This invention relates to an abrasive tool, and in particular, a tool with an interrupted cut pattern.

An abrasive tool may be used to sharpen, grind, hone, lap or debur a work piece or substrate of hard material, e.g., a knife. Such an abrasive tool may have a surface coated with abrasive grains such as diamond particles.

An abrasive tool having an abrasive surface with an interrupted cut pattern is known to be effective when applied to various work pieces. Abrasive tools must be rigid and durable for many commercial and industrial applications.

SUMMARY OF THE INVENTION

In general, in one aspect, the invention features an abrasive tool including a base having an upper surface and a perforated sheet having a lower surface and an upper surface. A layer of abrasive grains is bonded to the upper surface of the perforated sheet. The upper surface of the base is bonded to the lower surface of the perforated sheet by a first brazing material to support the perforated sheet.

Implementations of the invention may include one or more of the following features. The perforated sheet may have perforations arranged in an interrupted cut pattern. The perforated sheet may have perforations in a portion less than the entirety of the sheet.

The first brazing material may have a melting point lower than the melting point of the base and the sheet. The tool may be a file.

The base may include a hardened metal. The hardened metal may be steel. The base may be a solid structure or may be partially hollow. The abrasive tool may have a handle attached to the base.

The sheet may include steel or aluminum. The abrasive grains may be diamond particles or cubic boron nitride particles. The abrasive grains may be bonded to the upper surface of the sheet by a nickel plating. The abrasive grains may be bonded to the upper surface of the sheet by a second brazing material. The melting point of the second brazing material may be lower than or equal to the melting point of the first brazing material.

In general, in another aspect, the invention features a method of assembling an abrasive tool. A base having an upper surface and a perforated sheet having a lower surface and an upper surface are provided. The upper surface of the base and the lower surface of the perforated sheet are bonded by brazing the surfaces together to support the perforated sheet. A layer of abrasive grains is bonded to the upper surface of the perforated sheet.

Implementations of the invention may include one or more of the following features. The bonding of the base and the sheet may be performed prior to or at the same time as the bonding of the layer of abrasive grains.

The bonding of the upper surface of the base and the lower surface of the perforated sheet by brazing may include applying a shim between the upper surface of the base and the lower surface of the sheet and heating to melt the shim. The melting point of the shim may be lower than the melting point of the base and the sheet.

The method may include tack welding the sheet to the base prior to the bonding of the base and the sheet. The method may also include grinding the upper surface of the sheet prior to the bonding of the layer of abrasive grains to the upper surface of the sheet.

The bonding of the layer of abrasive grains to the upper surface of the sheet may include electroplating, anodizing or brazing.

An advantage of the present invention is the rigidity of the abrasive tool.

An additional advantage of the present invention is the flatness and dimensional stability of the abrasive tool.

A further advantage of the present invention is the strength and durability of the abrasive tool.

Other features and advantages of the invention will become apparent from the following detailed description, and from the claims.

DESCRIPTION OF THE PREFERRED EMBODIMENTS

An abrasive tool according to the present invention includes a base, and a sheet perforated with an interrupted cut pattern onto which abrasive grains are bonded.

Figure 1:
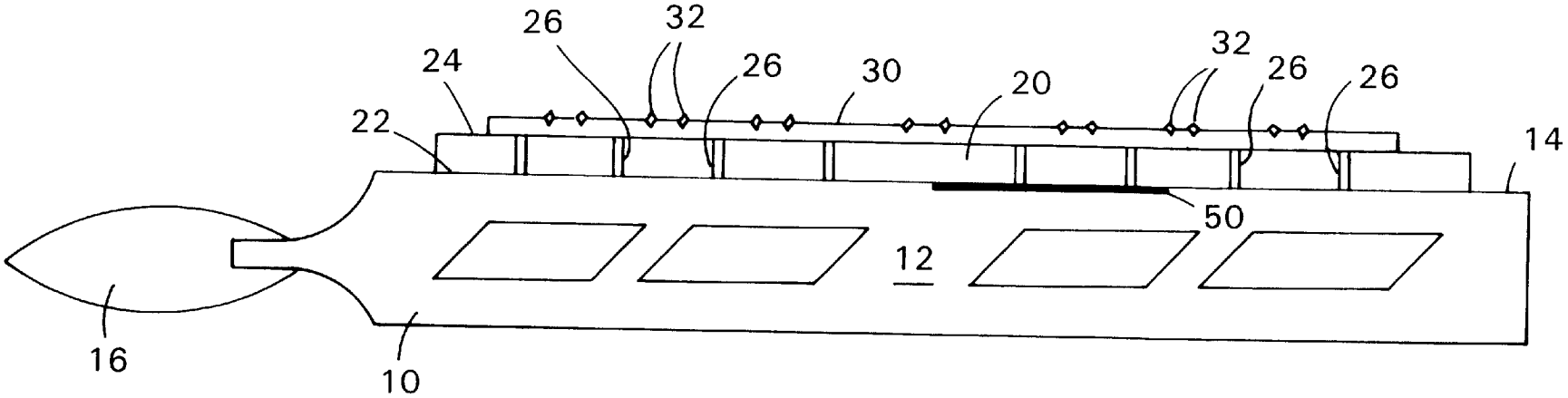
FIG. 1 is a side view of a file constructed according to the present invention.
Figure 2:
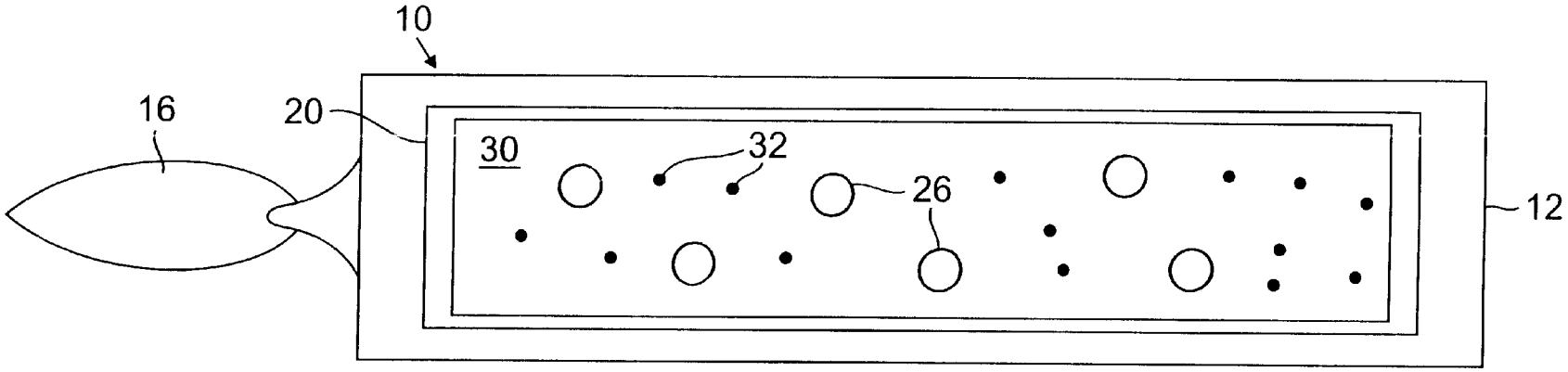
FIG. 2 is a top view of the file of FIG. 1.

As shown in FIGS. 1 and 2, the abrasive tool may be a hand-held file 10. The abrasive tool may also be, e.g., a whetstone, a grinding wheel or a slip stone. Base 12 may be any shape, e.g., flat, round, conical or curved.

File 10 includes a rigid base 12 made of a hardened metal, preferably steel. Base 12 has an upper surface 14. File 10 may also include a handle 16, which may be permanently fixed to base 12 or may be removable from base 12.

Base 12 may be formed as a solid structure. Alternately, base 12 may be partially hollow (FIG. 1), e.g., with a metal honeycomb structure, truss work structure, or tube and plate structure. Such a partially hollow base weighs less than a base with a solid structure, but is still highly rigid.

File 10 also includes a sheet 20. Sheet 20 may be made from any metal that can be brazed assembled to base 12, e.g., stainless steel or aluminum. Sheet 20 is preferably made from a hard metal such as steel.

Sheet 20 has a lower surface 22 and an upper surface 24. Sheet 20 contains perforations, e.g. round holes 26, extending through sheet 20 which form an interrupted cut pattern in sheet 20. The perforations may be arranged in any geometrical pattern of, e.g., square or diamond shaped holes. A preferred embodiment of the present invention includes a sheet for which 40% of the surface area has been cut out for the perforations.

A sheet with an interrupted cut pattern provides recesses into which filed or deburred particles or chips may fall while the abrasive tool is being used on a work piece. An abrasive tool with an interrupted cut pattern is able to cut or file the work piece faster by virtue of providing chip clearance.

Figure 3:
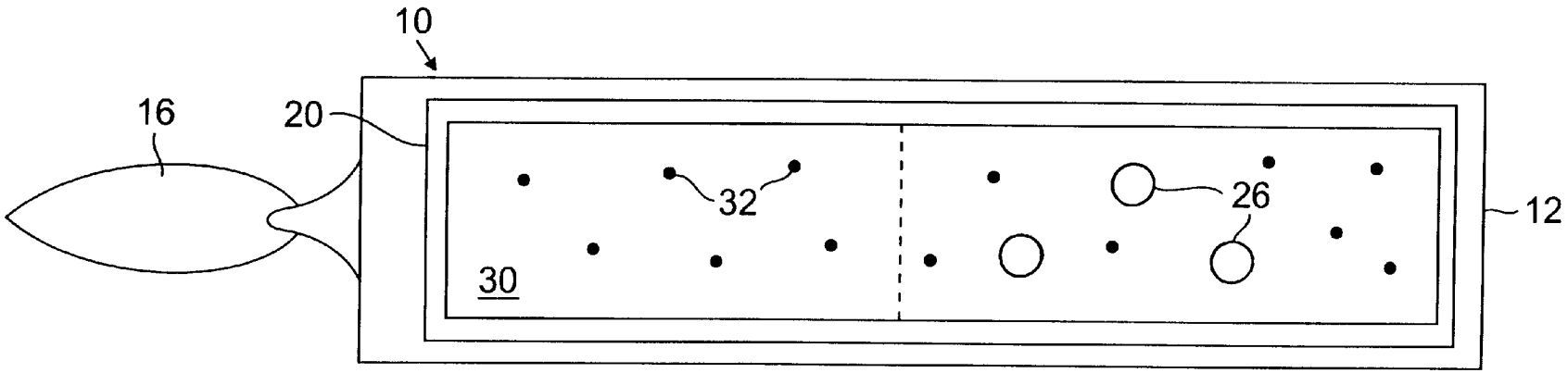
FIG. 3 is a top view of a file which is perforated over only a portion of its abrasive surface.

In an alternate embodiment, only a portion of sheet 20 contains an interrupted cut pattern, while the remainder contains no perforations (FIG. 3). Any arbitrary portion of sheet 20 may contain the interrupted cut pattern.

An abrasive surface 30 is formed on upper surface 24 of sheet 20. Abrasive surface 30 may be, e.g., a grinding, honing, lapping or deburring surface, and may be, e.g., flat or curved, depending on the shape and use of the abrasive tool.

Abrasive surface 30 is formed by bonding abrasive grains 32 to upper surface 24 of sheet 20. Abrasive grains 32 may be particles of, e.g., superabrasive diamond, polycrystalline diamond, or cubic boron nitride. Abrasive grains 32 may be bonded to upper surface 24 of sheet 20 by electroless or electrode plated nickel, solder bonding, or braze bonding.

Figure 4:
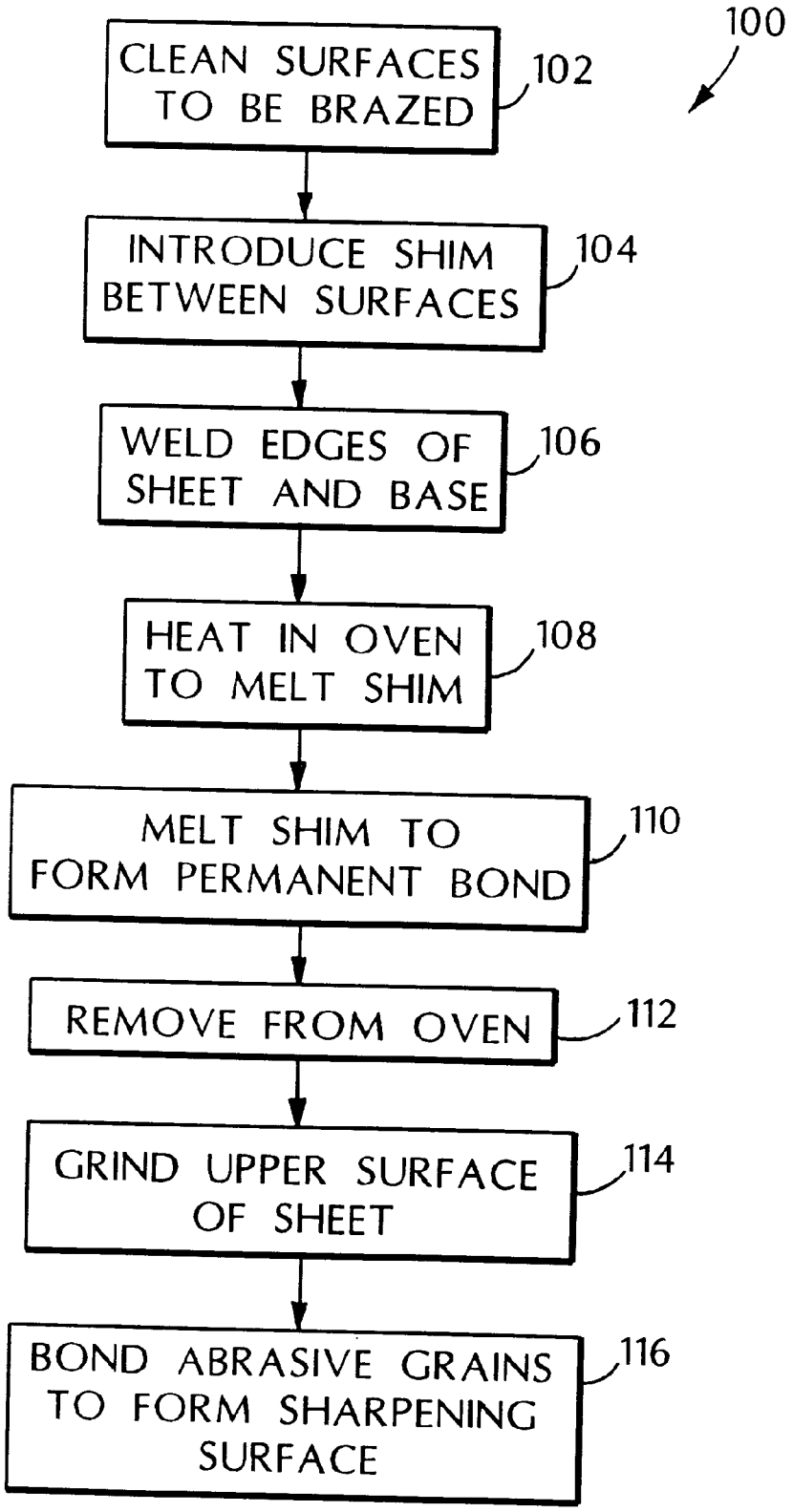
FIG. 4 is a flow chart showing a method of assembling an abrasive tool according to the present invention.

In a preferred embodiment, to construct file 10, perforated sheet 20 is attached to base 12 by brazing prior to forming abrasive surface 30 on upper surface 24 of sheet 20. FIG. 4 shows a method 100 for constructing file 10.

The surfaces to be brazed, i.e. upper surface 14 of base 12 and lower surface 22 of sheet 20, may be cleaned (step 102). A brazing material or shim 50 is introduced between these surfaces in the form of a paste, spray or thin solid layer (step 104). Shim 50 typically is an alloy of a metal and a flux material that has a melting point lower than the melting point of either base 12 or sheet 20.

Before or after the shim is applied, one or more edges of sheet 20 may optionally be tack welded to base 12 to prevent relative movement between sheet 20 and base 12 (step 106). Alternately, sheet 20 and base 12 may be clamped, e.g., with a graphite weight.

The assembled sheet 20 and base 12 are then heated in an oven to melt the shim (step 108). The oven may be filled with an inert gas, in which case the heating is accomplished by convection. Alternately, the oven may be evacuated, in which case the heating is accomplished by radiation.

When the temperature of the oven reaches the melting point of the shim, the shim melts and flows to bring sheet 20 and base 12 into intimate contact to form a permanent bond (step 110). Once the shim has melted, file 10 is removed from the oven (step 112). The resulting brazed bond between sheet 20 and base 12 has high strength properties upon solidification.

After sheet 20 has been bonded to base 12 by brazing, the upper surface 24 of sheet 20 may be ground for precision flatness (step 114). Abrasive grains 32 are then bonded to upper surface 24 of sheet 20 to form abrasive surface 30 (step 116).

Abrasive grains 32 may be bonded to upper surface 24 of sheet 20 by electroplating or anodizing aluminum pre-charged with diamond. See U.S. Pat. No. 3,287,862, which is incorporated herein by reference. Electroplating is a common bonding technique for most metals that applies Faraday's law. For example, the assembled base 12 and sheet 20 are attached to a negative voltage source and placed in a suspension containing positively charged nickel ions and diamond particles. As diamond particles fall onto upper surface 24 of sheet 20, nickel builds up around the particles to hold them in place. Thus, the diamond particles bonded to upper surface 24 of sheet 20 are partially buried in a layer of nickel.

In addition, the holes 26 in sheet 20 may be filled with a resist material before bonding the diamond particles to avoid depositing diamond particles inside holes 26. The resist material may be, e.g., a resin. The resist material may be left in place or removed from holes 26 after the diamond particles have been bonded to upper surface 24 of sheet 20.

Alternately, abrasive grains such as diamond particles may be sprinkled onto upper surface 24 of sheet 20, and then a polished steel roller which is harder than sheet 20 may be used to push the diamond particles into upper surface 24 of sheet 20. For example, in this case sheet 20 may be aluminum.

Alternately, the abrasive grains may be attached to the upper surface 24 of sheet 20 by brazing. For example, to bond diamond particles by brazing, a second soft, tacky shim, e.g., in the form of a paste, is applied to the upper surface 24 of sheet 20. Like the shim used to bond sheet 20 and base 12, the second shim is an alloy of a metal and a flux material that has a melting point lower than the melting point of sheet 20.

Diamond particles are poured onto the second shim, which holds many of them in place due to its tackiness. Excess diamond particles that do not adhere to the second shim may be poured off. File 10 is then heated until the second shim melts. Upon solidification, the diamond particles are embedded in the second shim, which is also securely bonded to the upper surface 24 of sheet 20. In this case, it is important that the melting point of the second shim used to braze the diamond particles to the upper surface 24 of sheet 20 be lower than the melting point of the shim used to braze sheet 20 to base 12. In addition, diamond particles can be kept out of the holes 26 in sheet 20 by failing to apply the second shim inside holes 26.

In an alternate embodiment, the abrasive grains are bonded to the upper surface 24 of sheet 20 by brazing at the same time that sheet 20 is bonded to base 12 by brazing. In this case, the same shim may be used to bond sheet 20 and base 12, and the abrasive grains and the upper surface 24 of sheet 20. This embodiment may be employed when upper surface 24 of sheet 20 need not be ground for precision flatness prior to attaching the abrasive grains.

A sheet perforated with an interrupted cut pattern onto which an abrasive grain is bonded, as described herein, may be attached by brazing to a single surface or to multiple surfaces of the base, such as for a two-sided whetstone or a two-sided grinding wheel.

Other embodiments are within the scope of the following claims.

What is claimed is:

1. An abrasive tool, comprising:

a base having an upper surface;

a perforated sheet having a lower surface and an upper surface; and a layer of abrasive grains bonded to the upper surface of the perforated sheet;

wherein the lower surface of the perforated sheet is disposed adjacent and supported by the upper surface of the base, and the upper surface of the base is bonded to the lower surface of the perforated sheet by a first brazing material.

2. The abrasive tool according to claim 1 wherein the perforated sheet has perforations arranged in an interrupted cut pattern.

3. The abrasive tool according to claim 1 wherein the base and the sheet have melting points, and the first brazing material has a melting point lower than the melting points of the base and the sheet.

4. The abrasive tool according to claim 1 wherein the perforated sheet has perforations in a portion less than the entirety of the sheet.

5. The abrasive tool according to claim 1 wherein the tool is a file.

6. The abrasive tool according to claim 1 wherein the base comprises a hardened metal.

7. The abrasive tool according to claim 6 wherein the hardened metal is steel.

8. The abrasive tool according to claim 1 wherein the base is a solid structure.

9. The abrasive tool according to claim 1 wherein the base is partially hollow.

10. The abrasive tool according to claim 1 further comprising a handle attached to the base.

11. The abrasive tool according to claim 1 wherein the sheet comprises steel.

12. The abrasive tool according to claim 1 wherein the sheet comprises aluminum.

13. The abrasive tool according to claim 1 wherein the abrasive grains are diamond particles.

14. The abrasive tool according to claim 1 wherein the abrasive grains are cubic boron nitride particles.

15. The abrasive tool according to claim 1 wherein the abrasive grains are bonded to the upper surface of the sheet by a nickel plating.

16. The abrasive tool according to claim 1 wherein the abrasive grains are bonded to the upper surface of the sheet by a second brazing material.

17. The abrasive tool according to claim 16 wherein the first brazing material has a melting point and the second brazing material has a melting point, and the melting point of the second brazing material is lower than the melting point of the first brazing material.

18. The abrasive tool according to claim 16 wherein the first brazing material has a melting point and the second brazing material has a melting point, and the melting point of the second brazing material is equal to the melting point of the first brazing material.

19. A method of assembling an abrasive tool, comprising:

providing a base having an upper surface, and a perforated sheet having a lower surface and an upper surface;

disposing the lower surface of the perforated sheet adjacent the upper surface of the base to support the perforated sheet;

bonding the upper surface of the base and the lower surface of the perforated sheet by brazing the surfaces together; and bonding a layer of abrasive grains to the upper surface of the perforated sheet.

20. The method of claim 19 wherein the bonding of the base and the sheet is performed prior to the bonding of the layer of abrasive grains.

21. The method of claim 19 wherein the bonding of the base and the sheet is performed at the same time as the bonding of the layer of abrasive grains.

22. The method of claim 19 wherein the bonding of the upper surface of the base and the lower surface of the perforated sheet by brazing comprises applying a shim between the upper surface of the base and the lower surface of the sheet and heating to melt the shim.

23. The method of claim 22 wherein the shim has a melting point and the base and the sheet have melting points, and the melting point of the shim is lower than the melting points of the base and the sheet.

24. The method of claim 19 further comprising tack welding the sheet to the base prior to the bonding of the base and the sheet.

25. The method of claim 19 further comprising grinding the upper surface of the sheet prior to the bonding of the layer of abrasive grains to the upper surface of the sheet.

26. The method of claim 19 wherein the bonding of the layer of abrasive grains to the upper surface of the sheet comprises electroplating.

27. The method of claim 19 wherein the bonding of the layer of abrasive grains to the upper surface of the sheet comprises anodizing.

28. The method of claim 19 wherein the bonding of the layer of abrasive grains to the upper surface of the sheet comprises brazing.

* * * * *